US005145596A

United States Patent [19]

Blank et al.

[11] Patent Number: 5,145,596

[45] Date of Patent: Sep. 8, 1992

[54] ANTIMICROBIAL RINSE CYCLE ADDITIVE

[75] Inventors: Lynne M. B. Blank, Brighton, N.Y.; William C. White, Midland, Mich.

[73] Assignee: Dow Corning Corporation, Midland, Mich.

[21] Appl. No.: 390,050

[22] Filed: Aug. 7, 1989

[51] Int. Cl.[5] ..... C11D 3/48; D06M 10/08

[52] U.S. Cl. ..... 252/106; 252/8.6; 252/8.7; 252/8.75; 252/8.8; 252/8.9; 252/DIG. 14

[58] Field of Search ..... 252/106, DIG. 14, 8.6, 252/8.7, 8.75, 8.8, 8.9

[56] References Cited

U.S. PATENT DOCUMENTS

| | | | |
|---|---|---|---|
| 3,560,385 | 2/1971 | Roth | 252/49.6 |
| 3,661,963 | 5/1972 | Pepe et al. | 260/448 |
| 3,730,701 | 5/1973 | Isquith et al. | 71/67 |
| 3,794,736 | 2/1974 | Abbott et al. | 424/78 |
| 3,817,739 | 6/1974 | Abbott et al. | 71/67 |
| 3,860,709 | 1/1975 | Abbott et al. | 424/184 |
| 3,865,728 | 2/1975 | Abbott et al. | 210/169 |
| 4,005,024 | 1/1977 | Rodriguez et al. | 252/89.1 |
| 4,005,025 | 1/1977 | Kinstedt | 252/89 |
| 4,005,028 | 1/1977 | Heckert et al. | 252/94 |
| 4,005,030 | 1/1977 | Heckert et al. | 252/140 |
| 4,161,518 | 1/1979 | Wen et al. | 424/52 |
| 4,259,103 | 3/1981 | Malek et al. | 71/67 |
| 4,282,366 | 8/1981 | Eudy | 556/413 |
| 4,371,577 | 2/1983 | Sato et al. | 428/96 |
| 4,394,378 | 7/1983 | Klein | 424/184 |
| 4,395,454 | 7/1983 | Baldwin | 428/290 |
| 4,406,892 | 9/1983 | Eudy | 424/184 |
| 4,408,996 | 10/1983 | Baldwin | 8/490 |
| 4,411,928 | 10/1983 | Baldwin | 427/2 |
| 4,414,268 | 11/1983 | Baldwin | 428/289 |
| 4,425,372 | 1/1984 | Baldwin | 427/2 |
| 4,446,035 | 5/1984 | Banatt et al. | 252/99 |
| 4,467,013 | 8/1984 | Baldwin | 428/289 |
| 4,472,327 | 9/1984 | Neefe | 264/1.9 |
| 4,504,541 | 3/1985 | Yasuda et al. | 428/264 |
| 4,557,854 | 12/1985 | Plueddemann | 252/174 |
| 4,564,456 | 1/1986 | Homan | 210/698 |
| 4,567,039 | 1/1986 | Stadnick | 132/70 |
| 4,614,675 | 9/1986 | Ona et al. | 427/387 |
| 4,615,882 | 10/1986 | Stockel | 424/80 |
| 4,615,937 | 10/1986 | Bouchette | 428/288 |
| 4,631,273 | 12/1986 | Blehm et al. | 514/29 |
| 4,631,297 | 12/1986 | Battice et al. | 521/78 |
| 4,682,992 | 7/1987 | Fuchs | 55/279 |
| 4,692,374 | 9/1987 | Bouchette | 428/288 |
| 4,721,511 | 1/1988 | Kupits | 8/188 |
| 4,772,593 | 9/1988 | Whalen et al. | 514/63 |
| 4,781,974 | 11/1988 | Bouchette | 428/288 |
| 4,822,667 | 4/1989 | Goad et al. | 428/265 |
| 4,835,019 | 5/1989 | White et al. | 427/387 |
| 4,842,766 | 6/1989 | White et al. | 252/309 |
| 5,064,613 | 11/1991 | Higgs et al. | 106/14.15 |

FOREIGN PATENT DOCUMENTS

| | | | |
|---|---|---|---|
| 1217004 | 1/1987 | Canada . | |
| 0076607 | 9/1982 | European Pat. Off. | 15/66 |
| 0108853 | 11/1982 | European Pat. Off. | 7/18 |
| 0239910 | 3/1987 | European Pat. Off. | 1/62 |
| 0356210 | 8/1989 | European Pat. Off. | 3/37 |
| 156809 | 3/1985 | Japan . | |
| 8601457 | 1/1987 | PCT Int'l Appl. . | |
| 1386876 | 3/1975 | United Kingdom . | |
| 1433303 | 4/1976 | United Kingdom . | |
| 2011967 | 10/1978 | United Kingdom | 13/46 |
| 2153399 | 1/1984 | United Kingdom | 15/643 |

OTHER PUBLICATIONS

Applied Microbiology, vol. 24, No. 6, Dec. 1972, A. J. Isquith et al, "Surface Bonded Antimicrobial Activity of an Organosilicon Quaternary Ammonium Chloride".

*Primary Examiner*—A. Lionel Clingman
*Assistant Examiner*—William S. Parks
*Attorney, Agent, or Firm*—Jim L. DeCesare

[57] ABSTRACT

A method of treating fabrics in order to eliminate odor caused by microbial growth by adding an antibacterially effective amount of an organosilicon quaternary ammonium compound to the rinse cycle of a textile laundering operation containing the fabrics in order to destroy bacteria and fungi. The organosilicon quaternary ammonium compound is the silane 3-(trimethoxysilyl) propyldimethyloctadecyl ammonium chloride of the formula

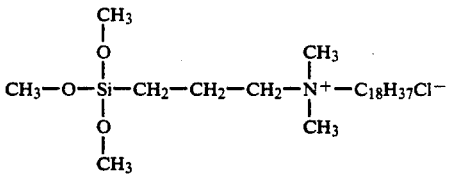

7 Claims, No Drawings

ANTIMICROBIAL RINSE CYCLE ADDITIVE

BACKGROUND OF THE INVENTION

This invention relates to a method of treating fabrics in the rinse cycle of a textile laundering operation with an antimicrobial agent in order to eliminate odor caused by microbial growth.

An antimicrobial is an agent that destroys or inhibits the growth of microorganisms. The major classes of microorganisms are bacteria, fungi including mold and mildew, yeasts, and algae. Microorganisms can be found in the air, the waters, the human body, soil, wastes, and on all surfaces. The organisms are deposited from the air, food and drink spills, dust, dirt and tracked in soil, and from human excreta such as sweat, urine, and feces. Organisms grow and multiply when there is available a nutrient source of food such as dirt, organic or inorganic material, and living tissue. For growth and multiplication, organisms also require warm temperatures, and moisture. When these conditions exist, microorganisms thrive and flourish. Microbial growth, however, leads to many problems such as unpleasant odors ranging from stale to musty and mildew-like, to putrid and foul smelling, resembling ammonia. The growths also produce unsightly stains, discoloration, and deterioration of many surfaces and materials in which they come into contact. A more serious disadvantage of microbial growth is the production of pathogenic microorganisms, germs, their metabolic products and their somatic and reproductive cell parts, which contribute to the spread of disease, infection, and disorders.

Antimicrobial agents are chemical compositions that are used to prevent such microbiological contaminations by inhibiting, killing and/or removing them and neutralizing their effects of deterioration, defacement, odor, disease or other negative effects. Particular areas of application of antimicrobial agents and compositions are, for example, cosmetics, disinfectants, sanitizers, wood preservation, food, animal feed, cooling water, metalworking fluids, hospital and medical uses, plastics and resins, petroleum, pulp and paper, textiles, latex, adhesives, leather and hides, and paint slurries. In the area of medical applications, antimicrobials are often used as powders, in lotions, creams, ointments and/or delivered in a variety of solvents or directly as over-the-counter or ethical drugs to alleviate, mediate, cure and/or protect people or other animals from disease or cosmetic conditions. Of the diverse categories of antimicrobial agents and compositions, quaternary ammonium compounds represent one of the largest of the classes of antimicrobial agents in use. At low concentrations, quaternary ammonium type antimicrobial agents are bacteriostatic, fungistatic, algistatic, sporostatic, and tuberculostatic. At medium concentrations they are bactericidal, fungicidal, algicidal, and viricidal against lipophilic viruses. Silicone quaternary ammonium salt compounds are well known as exemplified by U.S. Pat. No. 3,560,385, issued Feb. 2, 1971, and the use of such compounds as antimicrobial agents is taught, for example; in a wide variety of patents such as U.S. Pat. Nos. 3,730,701, issued May 1, 1973, and 3,817,739, issued Jun. 18, 1974, where the compounds are used to inhibit algae; 3,794,736, issued Feb. 26, 1974, and 3,860,709, issued Jan. 14, 1975, where they are employed for sterilizing or disinfecting a variety of surfaces and instruments; and 3,865,728, issued Feb. 11, 1975, where the compounds are used to treat aquarium filters. Published unexamined European Application No. 228464 of Jul. 15, 1987, teaches that microorganisms on multi-cellular plants can be killed by the application thereto of an aqueous mixture of a surfactant and an organosilicon quaternary ammonium compound. U.S. Pat. No. 4,564,456, issued Jan. 14, 1986, discloses organosilanes as anti-scale agents in water systems. In a particular application of an antimicrobial silicone quaternary ammonium compound, a paper substrate is rendered resistant to the growth of microorganisms in U.S. Pat. No. 4,282,366, issued Aug. 4, 1981. In U.S. Pat. No. 4,504,541, issued Mar. 12, 1985, an antimicrobial fabric is disclosed which is resistant to discoloration and yellowing by treatment of the fabric with a quaternary ammonium base containing an organosilicone. U.S. Pat. No. 4,615,937, issued Oct. 7, 1986, as well as its companion U.S. Pat. No. 4,692,374, issued Sep. 8, 1987, relate to wet wiper towelettes having an antimicrobial agent substantive to the fibers of the web and being an organosilicon quaternary ammonium compound. In a series of Burlington Industries, Inc. U.S. Pat. Nos. 4,408,996, issued Oct. 11, 1983, 4,414,268, issued Nov. 8, 1983, 4,425,372, issued Jan. 10, 1984, and 4,395,454, issued Jul. 26, 1983, such compounds are disclosed to be useful in surgical drapes, dressings, and bandages. This same assignee also discloses these compounds as being employed in surgeons' gowns in U.S. Pat. Nos. 4,411,928, issued Oct. 25, 1983, and 4,467,013, issued Aug. 21, 1984. Organosilicon quaternary ammonium compounds have been employed in carpets, in U.S. Pat. No. 4,371,577, issued Feb. 1, 1983; applied to walls, added to paints, and sprayed into shoes, in U.S. Pat. No. 4,394,378, issued Jul. 19, 1983; formulated as aqueous emulsions in U.S. Pat. No. 4,631,273, issued Dec. 23, 1986; applied to polyethylene surfaces and used in pillow ticking in U.S. Pat. No. 4,721,511, issued Jan. 26, 1988; in flexible polyurethane foams of fine-celled, soft, resilient articles of manufacture in U.S. Pat. No. 4,631,297, issued Dec. 23, 1986; and mixed with a surfactant in British Patent No. 1,386,876, of Mar. 12, 1975, and in Japanese Kokai Application No. 58-156809, filed Aug. 26, 1983, of Sanyo Chemical Industries, Ltd. Some general, more domestic type applications of these compounds, has included their use in a dentifrice as in U.S. Pat. No. 4,161,518 issued Jul. 17, 1979; in a novel laundry detergent in U.S. Pat. No. 4,557,854, issued Dec. 10, 1985; as a hair conditioner in U.S. Pat. No. 4,567,039, issued Jan. 28, 1986; and in a soft contact lens disinfectant solution in U.S. Pat. No. 4,615,882, issued Oct. 7, 1986. In U.S. Pat. No. 4,614,675, issued Sep. 30, 1986, properties can be influenced by mixing the silicone quaternary ammonium salt compounds with certain siloxanes.

Other typical uses of organosilicon quaternary ammonium compounds in accordance with the prior art can be seen from U.S. Pat. Nos. 4,005,024; '025; '028; and '030; each issued on Jan. 25, 1977, and relating to hard surface rinse aids and detergents for hard surfaces. Contact lenses are treated with an organosilane in U.S. Pat. No. 4,472,327, issued Sep. 18, 1984. In U.S. Pat. No. 4,682,992, issued Jul. 28, 1987, glass spheres are treated with the compounds and employed as filters. The compounds are used to treat swine dysentery in U.S. Pat. No. 4,772,593, issued Sep. 20, 1988; in a wet wiper in U.S. Pat. No. 4,781,974, issued Nov. 1, 1988; applied to a polyester fabric in U.S. Pat. No. 4,822,667, filed Apr. 18, 1989; and adhered to polyamide yarn in U.S. Pat.

No. 4,835,019, issued May 30, 1989. In Canadian Patent No. 1,217,004, granted Jan. 27, 1987, organosilane quaternary ammonium compounds are formulated into bleaches that are applied to hard surfaces such as bath tubs, wash basins, toilets, drains, and ceramic tile floors.

Modern washing machines work automatically and the operator places the laundry in the machine, pours in the detergent, and sets the controls. One set of controls determines whether the machine employs hot, warm, or cold water. Water enters the machine through hoses connected to the hot and cold water pipes. The operator also sets controls in order to select the length of washing and rinsing time, and the amount of water that enters the machine. The machine is powered by an electric motor and includes a filter that removes lint, and automatic dispensers for bleach and fabric softeners. A wash cycle typically includes four stages. In the wash cycle, after water fills the wash tub, an agitator reverses direction alternately and moves the laundry through the water and detergent, and forces water through the items of laundry. The washer is then emptied of all of the wash liquor in the spin cycle and the clothes are spun to remove excess water. In the rinse cycle, clean water is added along with the fabric softener and the clothes are again agitated. The washer is emptied of rinse liquor and the clothes are spun in a final spin cycle during which time excess water is removed and pumped out of the machine through a drain hose. The clothing is then ready to be removed from the machine and dried in a dryer or hung on a clothesline until dry.

Fabric treatments for use in such machines are well known in the art. For example, in British Patent No. 1,549,180, issued Jul. 25, 1979, Dumbrell et al disclose a fabric softener which includes, in addition to the softening benefit, the additional benefits of easier ironing, antistatic properties, pleasanter feel, and soil release properties. The additional benefits are stated to be derived from the inclusion along with a cationic quaternary ammonium fabric softening agent, of a silicone compound which is said to be an aqueous emulsion of a linear siloxane.

Specifically, Dumbrell et al relate to fabric softening compositions that include an aqueous dispersion of a cationic softening compound, and a silicone emulsion. The cationic compound is disclosed to be one or more or mixtures of a combination of quaternary monoammonium compounds such as tallowtrimethylammonium chloride, and ditetradecyldimethylammonium chloride; quaternary imidazolinium compounds; polyammonium compounds such as acid salts of diamine compounds, and polyamine salts; and polyalkyleneimine salts. The silicone emulsion is preferably a linear dialkyl or alkylaryl siloxane which may be partially or wholly fluorinated, or substituted with cationic nitrogen groups. The viscosity is disclosed to be, at twenty-five degrees Centigrade, at least one hundred and up to eight thousand centistokes. The weight ratio of siloxane content of the emulsion to the dispersion is five to one, to one to one-hundred. Representative compositions are said to be cationic emulsion polymerized dimethylsiloxanes, with the emulsifying agent being, for example, ditallowyldimethylammonium chloride; quaternized polysiloxanes such as dipyridinium polydimethylsiloxane; and aminofunctional linear polysiloxanes such as polydimethylsiloxanes containing dimethylaminopropyl groups.

It is not new to employ an organosilicon quaternary ammonium compound in a laundering environment. For example, in U.S. Pat. No. 4,557,854, issued Dec. 10, 1985, a powdered heavy duty laundry detergent is disclosed which contains insoluble particulate materials, the surfaces of which have been treated with a silane. It is also not new to employ organosilicon compounds in the rinse cycle of a fabric treating laundering operation. Aminofunctional polysiloxanes have been included as an additive in the rinse cycle in the aforementioned British Patent No. 1,549,180, granted Jul. 25, 1979 to Dumbrell et al. What is believed to be new and unique and what is disclosed in the present invention, however, is the concept of employing an organosilane which is an organosilicon quaternary ammonium compound in the rinse cycle of a fabric laundering operation.

There is a basic distinction between the aminofunctional polysiloxane employed in the rinse cycle in the British Patent 1,549,180, and the organosilane quaternary ammonium compound of the present invention when it is employed in the rinse cycle. While both compositions are organosilicon compounds, and while both are employed in the rinse cycle, the two compositions function in the rinse cycle in an entirely different fashion one from the other. For example, in the rinse cycle, the silane end of the organosilicon quaternary ammonium molecule of the present invention is substantive to natural textile surfaces such as cotton, wool, and jute, but the siloxane end of the aminofunctional organosilicon molecule of Dumbrell is not substantive to such surfaces. The organofunctional end of the organosilane quaternary ammonium molecule of the present invention is substantive to wetted surfaces and anionic surfaces such as synthetic textiles of the types nylon and polyester, but the aminofunctional end of the polysiloxane molecule of Dumbrell et al is not substantive to such surfaces. Further, the organosilane quaternary ammonium compounds of the present invention are antimicrobially active and hence are capable of killing microorganisms and preventing their proliferation, while the aminofunctional polysiloxanes of Dumbrell et al are not active antimicrobials. In addition, because of the substantive textile affinity of both ends of the molecule of the organosilane quaternary ammonium compounds of the present invention, the antimicrobial treatments rendered by these compounds are durable. This the aminofunctional polysiloxane of Dumbrell et al is incapable of duplicating.

The "unbound" antimicrobials of the prior art are not the equivalent of the "bound" antimicrobial organosilane of the present invention because the unbound antimicrobials do not perform substantially the same function, in substantially the same way, to produce substantially the same results, as do the bound silanes of the present invention. The function differs because the bound antimicrobial is permanent whereas the unbound types are easily washed away or rubbed from the surface. The compounds of the present invention are not only durable but retain their antimicrobial activity after some ten laundering cycles, and only slightly diminish in their activity after as many as twenty-five laundering cycles. The bound silanes of the present invention retain an effective kill level of microorganisms. The manner in which the bound silane functions differs from the unbound types, since the bound silane attaches itself to the surface to which it is applied, whereas the unbound types are mere coatings which are not substantive. This is significant since the silane antimicrobial will continue to prevent reinfestation, and enables one to utilize the intrinsic antimicrobial activity of the silane treated surface to kill transient microbes, long after the unbound types of antimicrobials have been depleted of their activity. Further, the bound silanes of the present invention destroy, reduce, and inhibit the growth and multiplication of bacteria, fungi, and other pathogenic microorganisms, by the disruption of cell membranes, a mechanism absent from conventional unbound antimicrobial materials. The results produced by the bound silanes is not the same as the results produced by the unbound types, since the bound silanes provide a prolonged antimicrobial activity and continue to kill and inhibit the proliferation of potentially destructive microorganisms, versus mere temporary and superficial protection offered by the unbound category of material.

Thus, it should be apparent that the method of the present invention in employing the bound antimicrobially active organosilicon quaternary ammonium compounds is far removed from methods that have been previously disclosed by the prior art.

Among the numerous attempts to alleviate the problems of microorganisms on surfaces have involved the use of soaps, detergents, and surface cleaners. The treatments, however, have for the most part included an unbound category of antimicrobial which is not actually bonded to the surface sought to be treated, and therefore is consumed by the microorganisms, with the result that the unbound antimicrobial is depleted and washed away during routine cleansing. As this diffusion continues, the concentration of the active ingredient becomes diluted below effective levels, with the result that the microorganisms sought to be inhibited, adapt and build up a tolerance, becoming immune to what was once an effective treatment dose. Such unbound diffusible antimicrobials have therefore been found to be limited in their ability to offer broad spectrum control of microorganisms, in contrast to the bound type of antimicrobial which remains chemically attached to the surface to which it is applied providing for a surface that prevents recolonization by the microflora associated therewith. Diffusing types of antimicrobials also often suffer from the propensity to transfer percutaneously, giving rise to sensitization and irritation immunological responses, and raising serious questions as to their ultimate fate within the body and body systems.

Bound antimicrobials kill organisms on contact and continue to kill organisms without being diffused or leached from the surface. Thus, the bound antimicrobial leaves behind an effective level of active ingredient and is able to control a broad spectrum of microorganisms including gram negative and gram positive bacteria, mold, mildew, fungi, yeast, and algae. An exemplary category of bound antimicrobial is an alkoxysilane quaternary ammonium compound, and such alkoxysilane quaternary ammonium compounds have been found to be more effective at reducing the number of microorganisms, and inhibiting microbially generated odors, than conventional organotin compounds and other organic quaternary ammonium compounds. The silanes of the present invention immobilize on surfaces and bond thereto to provide a coating of immobilized antimicrobial, unlike conventional materials.

In the present invention, this bound characteristic of alkoxysilane quaternary ammonium compounds, as well as their capabilities of performing at effective kill levels beyond prior art types of compositions, is taken advantage of in the treatment of fabrics, in order to reduce or substantially eliminate the incidence of microorganisms, germs, their metabolic products and their somatic and reproductive cell parts, which contribute to the spread of such microbes.

SUMMARY OF THE INVENTION

This invention relates to a method of treating fabrics in order to eliminate odor caused by microbial growth by adding an antibacterially effective amount of an organosilicon quaternary ammonium compound to the rinse cycle of a textile laundering operation containing the fabrics in order to destroy bacteria and fungi, the organosilicon quaternary ammonium compound being an organosilane having the formula selected from the group consisting of

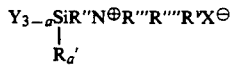

and

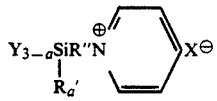

wherein, in each formula,

Y is R or RO where each R is an alkyl radical of 1 to 4 carbon atoms or hydrogen;

a has a value of 0, 1 or 2;

R′ is a methyl or ethyl radical;

R″ is an alkylene group of 1 to 4 carbon atoms;

R‴, R⁗ and $R^{v}$ are each independently selected from a group consisting of alkyl radicals of 1 to 18 carbon atoms, $—CH_2C_6H_5$, $—CH_2CH_2OH$, $—CH_2OH$, and $—(CH_2)_xNHC(O)R^{vi}$, wherein x has a value of from 2 to 10 and $R^{vi}$ is a perfluoroalkyl radical having from 1 to 12 carbon atoms; and X is chloride, bromide, fluoride, iodide, acetate or tosylate.

In one embodiment, the treatment can be applied in the form of an emulsion including water, the silane, and a water immiscible liquid which is a polysiloxane selected from the group consisting of polysiloxanes having the general formula $$R'_3SiO(R''_2SiO)_w(R'''QSiO)_2SiR_{p'3} \text{ and } (R'R''SiO)_y$$

wherein R′ is an alkyl radical of 1 to 3 carbon atoms, phenyl, an alkoxy radical having the formula R⁗O—, wherein R⁗ is an alkyl radical of 1 to 4 carbon atoms or hydrogen; R″ is an alkyl radical of 1 or 2 carbon atoms or the phenyl group; R‴ has the same meaning as R″; Q is a substituted or unsubstituted radical composed of carbon and hydrogen, or carbon, hydrogen and oxygen, or carbon, hydrogen and sulfur, or carbon, hydrogen and nitrogen; w has a value of from 1 to 500; z has a value of 1 to 25 and y has a value of 3 to 5.

In some other more specific embodiments of the present invention, the organosilane can be added to the rinse cycle in the amount of from 0.001 to 0.025 percent by weight based on the weight of the fabrics. The organosilane may be added to the rinse cycle in the form of a solution in methanol containing about forty-two percent by weight of the organosilane active ingredient; in the form of a solution in methanol containing about seventy-two percent by weight of the organosilane active ingredient; in the form of a solution in propylene glycol containing about sixty-five percent by weight of the organosilane active ingredient; in the form of an emulsion containing the organosilane active ingredient as noted above; or in the form of a microemulsion containing the organosilane active ingredient.

The organosilane may be added to the rinse cycle in any of the above forms in a sequential series of incremental steps which are conducted until the additive effect of the organosilane deposit on the fabrics reaches an amount approximating 0.025 percent by weight of the organosilane active ingredient based on the weight of the fabrics.

In a preferred embodiment, the organosilane is added to the rinse cycle in admixture with an organic quaternary ammonium compound, the organosilane and the organic quaternary ammonium compound being added to the rinse cycle in an amount of about 0.01 percent by weight of the admixture based on the weight of the fabrics. In this embodiment, the organosilane and the organic quaternary ammonium compound are each present in the admixture in approximately equal amounts by weight. In this embodiment, a synergistic effect is achieved in employing both the organosilane and the organic quaternary ammonium compound in admixture, whereas the use of either component individually at the 0.01 percent level is ineffective.

The most preferred organosilane quaternary ammonium compound for application in accordance with the method of the present invention is 3-(trimethoxysilyl) propyldimethyloctadecyl ammonium chloride of the formula

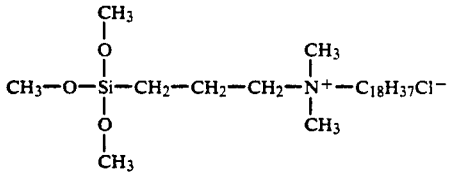

In any of the foregoing embodiments, it should be noted that the active ingredients including the organosilane are present in amounts much lower than industrial treatment levels which may employ as much as upwards of one-tenth of one percent to one percent by weight of active ingredient.

It is also an object of the present invention to provide a rinse cycle fabric laundering additive composition which is a mixture of at least one organic quaternary ammonium compound, and at least one organosilicon quaternary ammonium compound, the organosilicon quaternary ammonium compound being an organosilane having the formulae described hereinabove.

These and other features, objects, and advantages, of the present invention will be apparent when considered in light of the following detailed description thereof.

DETAILED DESCRIPTION OF THE INVENTION

Ammonium compounds in which all of the hydrogen atoms on nitrogen have been substituted by alkyl groups are called quaternary ammonium salts. These compounds may be represented in a general sense by the formula:

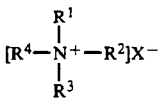

The nitrogen atom includes four covalently bonded substituents that provide a cationic charge. The R groups can be any organic substituent that provides for a carbon and nitrogen bond with similar and dissimilar R groups. The counterion X is typically halogen. Use of quaternary ammonium compounds is based on the hydrophilic portion of the molecule which bears a positive charge. Since most surfaces are negatively charged, solutions of these cationic surface active agents are readily adsorbed to the negatively charged surface. This affinity for negatively charged surfaces is exhibited by 3-(trimethoxysilyl)propyldimethyloctadecyl ammonium chloride of the formula:

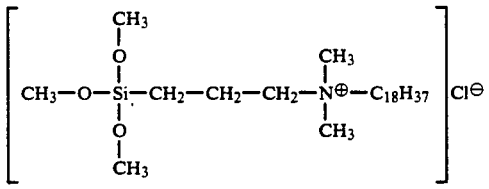

In the presence of moisture, this antimicrobial agent imparts a durable, wash resistant, broad spectrum biostatic surface antimicrobial finish to a substrate. The organosilicon quaternary ammonium compound is leach resistant, nonmigrating, and is not consumed by microorganisms. It is effective against gram positive and gram negative bacteria, fungi algae, yeasts, mold, rot, and mildew. The silicone quaternary ammonium salt provides durable, bacteriostatic, fungistatic, and algistatic surfaces. It can be applied to organic or inorganic surfaces as a dilute aqueous or solvent solution of 0.1–1.5 percent by weight of active ingredient. After the alkoxysilane is applied to a surface, it is chemically bonded to the substrate by condensation of the silanol groups at the surface. The pure compound is crystalline whereas methanol solutions of the compound are low viscosity, light to dark amber liquids, soluble in water, alcohols, ketones, esters, hydrocarbons, and chlorinated hydrocarbons. The compound has been used in applications such as, for example, socks, filtration media, bed sheets, blankets, bedspreads, carpet, draperies, fire hose fabric materials, humidifier belts, mattress pads, health care apparel, mattress ticking, underwear, nonwoven disposable diapers, nonwoven fabrics, outerwear fabrics, nylon hosiery, vinyl paper, wallpaper, polyurethane cushions, roofing materials, sand bags, tents, tarpaulins, sails, rope, blood pressure cuffs, athletic and casual shoes, shoe insoles, shower curtains, toilet tanks, toilet seat covers, throw rugs, towels, umbrellas, upholstery fiberfill, intimate apparel, wiping cloths, and medical devices such as blood pressure cuffs.

In the Examples as well as in the Tables, the composition identified as TMS refers to a product manufactured by the Dow Corning Corporation, Midland, Michigan, as an antimicrobial agent. This compound is 3-(trimethoxysilyl)-propyloctadecyldimethyl ammonium chloride referred to above diluted to forty-two percent active ingredients by weight with methanol.

The silanes useful in this invention have the general formula $$(RO)_{3-a}\underset{\underset{R'a}{|}}{Si}R''N^{\oplus}R'''R''''R^{v}X^{\ominus} \text{ and } (RO)_{3-a}\underset{\underset{R'a}{|}}{Si}R'$$

It should be noted that generically, these materials are quaternary ammonium salts of silanes. Most of the silanes falling within the scope of this invention are known silanes and references disclosing such silanes are numerous. One such reference, U.S. Pat. No. 4,259,103, issued to James R. Malek and John L. Speier, on Mar. 31, 1981, discusses the use of such silanes to render the surfaces of certain substrates antimicrobial. British Patent No. 1,433,303, issued to Charles A. Roth shows the use of fillers treated with certain silanes to be used in paints and the like to give antimicrobial effects.

Numerous other publications have disclosed such silanes, namely, A. J. Isquith, E. A. Abbott and P. A. Walters, Applied Microbiology, December, 1972, pages 859-863; P. A. Walters, E. A. Abbott and A. J. Isquith, Applied Microbiology, 25, No. 2, p. 253-256, February 1973 and E. A. Abbott and A. J. Isquith, U.S. Pat. No. 3,794,736 issued Feb. 26, 1974, U.S. Pat. No. 4,406,892, issued Sep. 27, 1983, among others.

For purposes of this invention, the silanes can be used neat or they can be used in solvent or aqueous-solvent solutions. When the silanes are used neat, the inventive process is preferably carried out in a system in which some small amount of water is present. If it is not possible to have a system with some small amount of water present, then a water soluble or water-dispersable, low molecular weight hydrolyzate of the silane may be used. What is important is the fact that the durability of any effect produced by the silane as part of a product requires that the silane molecule react with a surface to a certain extent. The most reactive species, as far as the silanes are concerned, is the ≡SiOH that is formed by hydrolysis of the alkoxy groups present on the silane. The ≡SiOH groups tend to react with the surface and bind the silanes to the surface. It is believed by the inventor that even though the prime mode of coupling to the surface system is by the route described above, it is also believed by the inventor that the alkoxy groups on the silicon atom may also participate in their own right to bind to the surface.

Preferred for this invention is a reactive surface containing some small amount of water. By "reactive", it is meant that the surface must contain some groups which will react with some of the silanols generated by hydrolysis of the silanes of this invention.

R in the silanes of this invention are alkyl groups of 1 to 4 carbon atoms. Thus, useful as R in this invention are the methyl, ethyl, propyl and butyl radicals. In the above formulas RO can also be R. R can also be hydrogen thus indicating the silanol form, i.e. the hydrolyzate. The value of a is 0, 1 or 2 and R' is a methyl or ethyl radical.

R'' for purposes of this invention is an alkylene group of 1 to 4 carbon atoms. Thus, R'' can be alkylene groups such as methylene, ethylene, propylene, and butylene. R''', R'''', and $R^{v}$ are each independently selected from a group which consists of alkyl radicals of 1 to 18 carbons, $-CH_2C_6H_5$, $-CH_2CH_2OH$, $-CH_2OH$, and $-(CH_2)_xNHC(O)R^{vi}$. x has a value of from 2 to 10 and $R^{vi}$ is a perfluoroalkyl radical having from 1 to 12 carbon atoms. X is chloride, bromide, fluoride, iodide, acetate or tosylate.

Preferred for this invention are the silanes of the general formula $$(RO)_{3-a}\underset{\underset{R'a}{|}}{Si}R''N^{\oplus}R'''R''''R^{v}X^{\oplus} \text{ wherein}$$

R is methyl or ethyl; a has a value of zero; R'' is propylene; R''' is methyl or ethyl; R'''' and $R^{v}$ are selected from alkyl groups containing 1 to 18 carbon atoms wherein at least one such group is larger than eight carbon atoms and x is either chloride, acetate or tosylate.

Exemplary silanes for this invention are those silanes having the formula $$(CH_3O)_3Si(CH_2)_3N^{\oplus}(CH_3)_2C_{18}H_{37}Cl^{-} \text{ and}$$
$$(CH_3O)_3Si(CH_2)_3\text{-}N^{\oplus}CH_3(C_{10}H_{21})_2Cl^{-}.$$

As indicated above, most of these silanes are known from the literature and methods for their preparation are known as well. See, for example, U.S. Pat. No. 4,282,366, issued Aug. 4, 1981; U.S. Pat. No. 4,394,378, issued Jul. 19, 1983, and U.S. Pat. No. 3,661,963 issued May 9, 1972, among others.

Specific silanes within the scope of the invention are represented by the formulae:

$(CH_3O)_3Si(CH_2)_3N^{+}(CH_3)_2C_{18}H_{37}Cl^{-}$,
$(CH_3O)_3Si(CH_2)_3N^{+}(CH_3)_2C_{18}H_{37}Br^{-}$,
$(CH_3O)_3Si(CH_2)_3N^{+}(C_{10}H_{21})_2CH_3Cl^{-}$,
$(CH_3O)_3Si(CH_2)_3N^{+}(C_{10}H_{21})_2CH_3Br^{-}$,
$(CH_3O)_3Si(CH_2)_3N^{+}(CH_3)_3Cl^{-}$,
$(CH_3O)_3SiCH_2CH_2CH_2P^{+}(C_6H_5)_3Cl^{-}$,
$(CH_3O)_3SiCH_2CH_2CH_2P^{+}(C_6H_5)_3Br^{-}$,
$(CH_3O)_3SiCH_2CH_2CH_2P^{+}(CH_3)_3Cl^{-}$,
$(CH_3O)_3SiCH_2CH_2CH_2P^{+}(C_6H_{13})_3Cl^{-}$,
$(CH_3)_3Si(CH_2)_3N^{+}(CH_3)_2C_{12}H_{25}Cl^{-}$,
$(CH_3)_3Si(CH_2)_3N^{+}(C_{10}H_{21})_2CH_3Cl^{-}$,
$(CH_3)_3Si(CH_2)_3N^{+}(CH_3)_2C_{18}H_{37}Cl^{-}$,
$(CH_3O)_3Si(CH_2)_3N^{+}(CH_3)_2C_4H_9Cl^{-}$,
$(C_2H_5O)_3Si(CH_2)_3N^{+}(CH_3)_2C_{18}H_{37}Cl^{-}$,
$(CH_3O)_3Si(CH_2)_3N^{+}(CH_3)_2CH_2C_6H_5Cl^{-}$,
$(CH_3O)_3Si(CH_2)_3N^{+}(CH_3)_2CH_2CH_2OHCl^{-}$,

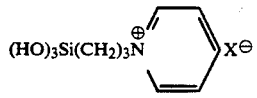

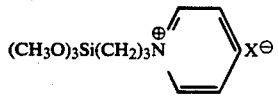

$(CH_3O)_3Si(CH_2)_3N^{+}(CH_3)_2(CH_2)_3NHC(O)(CF_2)_6CF_3Cl^{-}$,
$(CH_3O)_3Si(CH_2)_3N^{+}(C_2H_5)_3Cl^{-}$.

The water immiscible liquids, or volatiles as used in the emulsions of the present invention, are silicone oils which are highly volatile, and low in viscosity and molecular weight. For example, there may be employed trimethylsiloxy endblocked polydimethylsiloxanes, cyclic siloxanes such as dimethylsiloxane cyclic tetramer, and phenylmethyl fluids such as linear polyphenylmethylsiloxanes. Preferred for this invention are those silicone oils having a viscosity at twenty-five degrees Centigrade ranging from about 0.65 cs to about one thousand cs. A particularly preferred range is from about 0.65 cs to about 20 cs, although those silicone oils of viscosities of 50 cs, and 350 cs, can be employed. These silicone oils are more particularly described and set forth in detail in U.S. Pat. No. 4,631,273, issued Dec. 23, 1986, the disclosure of which is incorporated herein by reference. Such silicone oils are siloxanes which are low molecular weight cyclics and polysiloxanes having the general formula $$R'_3SiO(R''_2SiO)_w(R'''QSiO)_2SiR_{p'3} \text{ and } (R'R''SiO)_y$$

wherein R' is an alkyl radical of 1 to 3 carbon atoms, phenyl, an alkoxy radical having the formula R''''O—, wherein R'''' is an alkyl radical of 1 to 4 carbon atoms or hydrogen; R'' is an alkyl radical of 1 or 2 carbon atoms or the phenyl group; R''' has the same meaning as R''; Q is a substituted or unsubstituted radical composed of carbon and hydrogen, or carbon, hydrogen and oxygen, or carbon, hydrogen and sulfur, or carbon, hydrogen and nitrogen; w has a value of from 1 to 500; z has a value of 1 to 25 and y has a value of 3 to 5.

The organosilane may also be employed in accordance with the present invention in the form of a microemulsion containing the organosilane. Such microemulsions and their preparation are described in applicants' prior copending application U.S. Ser. No. 07/015,645, filed Feb. 17, 1987, and assigned to the same assignee as the present application. Solutions with particle sizes less than 0.150 microns are disclosed which are either oil-in-water or water-in-oil microemulsions including the organosilane and at least one surfactant. The prior copending application relating to the microemulsions is considered incorporated herein by reference, as is U.S. Pat. No. 4,631,273, issued Dec. 23, 1986, relating to the formation of emulsions including the organosilanes of the present invention. The '273 patent is also assigned to the same assignee as the present application.

In accordance with the present invention, the organosilane may be mixed with organic quaternary ammonium salts, and specifically any of the cationic compounds described in British Patent No. 1,549,180, such as quaternary mono-ammonium compounds having either two $C_{12}$–$C_{20}$ alkyl chains or one $C_{18}$–$C_{24}$ alkyl chain; quaternary imidazolinium textile softeners; polyammonium compounds; fabric softening polyamine salts; fully substituted polyquaternary compounds; and polyalkylene imine salts. Particular quaternary ammonium compounds suitable for use herein may include, for example, trimethyltallowammonium chloride, trimethylsoyaammonium chloride, trimethylcocoammonium chloride, dimethyldicocoammonium chloride, dimethyldi(hydrogenated tallow)ammonium chloride, trimethyldodecylammonium chloride, trimethyloctadecylammonium chloride, trimethylhexadecylammonium chloride, dimethylalkylbenzylammonium chloride, 1:1 mixture of trimethyltallowammonium chloride and dimethyldicocoammonium chloride, N,N,N',N',N'-pentamethyl-N-tallow-1,3-propanediammonium dichloride, methylbis(2-hydroxyethyl)cocoammonium chloride, chloride, methylpolyoxyethylene cocoammonium chloride, methylbis(2-hydroxyethyl)oleylammonium chloride, methylpolyoxyethylene oleyammonium chloride, methylbis(2-hydroxyethyl)oleylammonium chloride, methylbis(2-hydroxyethyl)octadecylammonium chloride, methylpolyoxyethylene octadecylammonium chloride, n-dodecyl tetradecyl dimethylbenzylammonium chloride, n-tetradecyl hexadecyl dimethylbenzylammonium chloride, n-dodecyl tetradecyl dimethyldichlorobenzylammonium chloride, n-octadecyldimethylbenzylammonium chloride, dialkylmethylbenzylammonium chloride, n-dodecyl tetradecyl hexadecyl dimethylbenzylammonium chloride, n-dodecyl tetradecyl hexadecyl dimethylethylbenzylammonium chloride, methyl sulfate quaternary of ethyoxylated tallow diethylenetriamine condensate, methyl sulfate quaternary of propoxylated tallow diethylenetriamine condensate, and 1-(tallow amidoethylene)-2-nor (tallow alkyl)-2-imidazolinium, methyl sulfate quaternary.

Various procedures are employed in order to test the organosilanes of the present invention. For example, the presence of the chemical on a substrate can be determined by complexing a standardized solution of bromophenol blue in water with the quaternary nitrogen of the organosilane and recording the color change spectrophotometrically. Results of this test can be used in order to determine whether the organosilane has bound itself to a particular surface. Such a test procedure is set forth below.

The anion of an aqueous sodium salt of bromphenol blue can be complexed with the cation of polymerized silanes of this invention while on a substrate. The blue colored complex, substantive to a water rinse, is qualitatively indicative of the presence of the cation on the substrate thus indicating the extent of antimicrobial agent on a given substrate. A comparison of the intensity of retained blue color to a color standard is used as a check to determine if the treatment has been applied properly.

One method consists of preparing a 0.02 to 0.04 weight percent solution of bromphenol blue in distilled water. This solution is made alkaline using a few drops of saturated $Na_2CO_3$ solution per 100 milliliters of the solution. Two to three drops of this solution are placed on the treated substrate and allowed to stand for two minutes. The substrate is then rinsed with copious amounts of tap water and the substrate is observed for a blue stain and it is compared to a color standard.

For a spectrophotometric determination, the following test is used. The sodium salt of bromphenol blue is depleted from a standard solution by complexing with the cations on a treated substrate. The change in bromphenol blue concentration is determined spectrophotometrically or by comparison with color standards whereby the level of substrate treatment by the cationic silane is determinable.

The method consists of preparing a 0.02 weight percent standard solution of bromphenol blue in distilled water. It is made alkaline with a few drops of saturated $Na_2CO_3$ solution per 100 milliliters of bromphenol blue solution. The color of this solution is purple. The blank solution is adjusted to yield a 10 to 12% transmittance reading when measured in 1 cm cells using a spectrophotometer set at 589 nm by the following method. Fill a container ¾ full of distilled water and add 2 ml of the 0.02% standard bromphenol blue solution for every 50 ml of distilled water. Add 0.5 ml of a 1% Triton® X-100 surfactant (manufactured by Rohm and Haas, Philadelphia, PA, USA) aqueous solution for every 50 ml of water. Mix, and using the spectrophotometer, determine the maximum absorbance. Adjust the upper zero to 100% transmittance with distilled water. Check the percent transmittance of the working bromphenol blue solution at the maximum absorbance setting. Adjust the blank solution to 10 to 12% transmittance with either water or bromphenol blue standard solution as necessary.

The samples of treated substrate can be tested by placing 0.5 gram samples of the substrate standards in a flask large enough for substantial agitation of the sample and the test solution. Add 50 ml of the working solution. Agitate for 20 minutes on a wrist-action shaker. Fill the test curvette with the test solution. Centrifuge if particulate matter is present. Measure the % transmittance at the wavelength set forth above. The transmittance is compared against a standard curve prepared by preparing several substrate samples of known concentration of the cationic silane. For example, samples containing a known amount of cationic silane at, for example, 0%, 0.25%, 0.50%, 0.75% and 1% are read spectrophotometrically and a curve is plotted.

The antimicrobial activity of a treated surface is normally evaluated by shaking a sample weighing 0.75 grams in a 750,000 to 1,500,000 count *Klebsiella pneumoniae* suspension for a one hour contact time. The suspension is serially diluted, both before and after contact, and cultured. The number of viable organisms in the suspensions is determined. The percent reduction based on the original count is determined. The method is intended for those surfaces having a reduction capability of 75 to 100% for the specified contact time. The results are reported as the percent reduction. Media used in this test are nutrient broth, catalog No. 0003-01-6 and tryptone glucose extract agar, catalog No. 0002-01-7 both available from Difco Laboratories, Detroit, Michigan, U.S.A. The microorganism used is *Klebsiella pneumoniae* American Type Culture Collection; Rockville, Md. U.S.A., catalog No. 4352. The procedure used for determining the zero contact time counts is carried out by utilizing two sterile 250 ml. screw-cap Erlenmeyer flasks for each sample. To each flask is added 70 ml of sterile buffer solution. To each flask is added, aseptically, 5 ml of the organism inoculum. The flasks are capped and placed on a wrist action shaker. They are shaken at maximum speed for 1 minute. Each flask is considered to be at zero contact time and is immediately subsampled by transferring 1 ml of each solution to a separate test tube containing 9 ml of sterile buffer. The tubes are agitated with a vortex mixer and then 1 ml of each solution is transferred to a second test tube containing 9 ml of sterile buffer. Then, after agitation of the tubes, 1 ml of each tube is transferred to a separate sterile petri dish. Duplicates are also prepared. Sixteen ml of molten (42° C.) tryptone glucose extract agar is added to each dish. The dishes are each rotated ten times clockwise and ten times counterclockwise. The dishes are then incubated at 37° C. for 24 to 36 hours. The colonies are counted considering only those between 30 and 300 count as significant. Duplicate samples are averaged. The procedure used for determining the bacterial count after 1 hour is essentially the same as that used to determine the count at the zero contact time. The only difference is that pour plating is performed at the $10^0$ and $10^{-1}$ dilutions as well as at the $10^{-2}$ dilution. "Percent reduction" is calculated by the formula $$\% R = \frac{\frac{B+C}{2} - A_{100}}{\frac{B+C}{2}}$$

where A is the count per milliliter for the flask containing the treated substrate; B is zero contact time count per milliliter for the flask used to determine "A" before the addition of the treated substrate and C is zero contact time count per milliliter for the untreated control substrate.

The foregoing Shake Flask Test measures antimicrobial substrate activity. An alternative test sometimes employed is the Agar Plate Graphing Technique which again affords a measure of antimicrobial substrate activity, in which treated swatches of fabric are placed on agar impregnated with *Klebsiella pneumoniae*. Antimicrobial activity is measured by the existence of a zone of inhibition and diffusability in the agar.

It is also possible to measure antimicrobial solution activity and this is performed in accordance with the procedures of the Minimum Inhibitory Concentration Test(MIC) in which the level of chemical required to inhibit the growth of microorganisms in a system is determined, typically employing organisms such as *Staphylococcus aureus, Klebsiella pneumoniae*, and *Aspergillus niger.*

One species of organosilane and an organosilicon quaternary ammonium compound in accordance with the present invention is 3-(trimethoxysilyl) propyldimethyloctadecyl ammonium chloride of the formula:

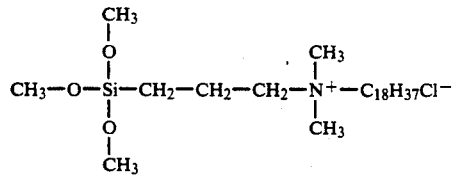

This complex molecule has three active areas. The presence in the molecule of the long chain aliphatic alkyl group $C_{18}H_{37}$ which is non-polar and oil-like, determines the hydrophobic/oleophilic properties of the molecule. The molecule attaches itself to surfaces via the methoxy silane functionality which serves as the anchor or coupler, whereas the quaternary ammonium salt functionality portion of the molecule which is cationically charged, performs the antimicrobial or microorganism killing function.

It is this unique and complex arrangement which sets the organosilicon compounds of the present invention apart from the conventional organic antimicrobial materials of the prior art.

The antimicrobial agents described herein may be employed in a number of forms and in a number of delivery mechanisms, some of which are applicable to the treatment herein. For example, water solutions of the organosilanes may be used as the delivery medium for the treatment. Treated powders such as silica, fumed silica, talc, diatomaceous earth, and sand, are representative of particulates that may be employed to deliver the organosilanes. Water soluble powders may also be used such as sugar or aluminum chlorohydrate, and in this form, dissolution of the substrate frees the organosilane for coupling to another substrate. Solvent solutions may be used, and such solvent solutions maintain the organosilane in an otherwise unhydrolyzed form. Propylene glycol can also be used to deliver the organosilane, and when mixed with water and a surfactant, microemulsions are formed. Gels of water solutions of the organosilane can be prepared by adding sodium chloride, and substrates are treated by contacting a surface of the substrate with the gel. The organosilanes may be blended with various organic acids to provide a synergistic action, and as noted above, the organosilanes may be delivered in the form of emulsions and microemulsions.

The following examples illustrate the concepts of the present invention.

EXAMPLE I

Three different textile goods were treated in a top loading MAYTAG washer with 0.75 weight percent based on weight of fabrics of TMS (3-trimethoxysilylpropyl dimethyloctadecyl ammonium chloride). The textile goods were a bundle of mixed 100 percent cotton T-shirts; 50 percent acrylic and 50 percent cotton sweat shirts; and 100 percent cotton toweling. In order to assimilate only the rinse cycle in the washer, no detergent was employed, and a special treatment protocol was followed in the washer. The machine including the fabric bundle was filled with water at 150 degrees Fahrenheit. The silane antimicrobial was added and the machine was agitated. This was followed by a soak cycle, after which the water was drained from the machine and the bundle spun dry and transferred to a MAYTAG dryer to be dried. The percent reduction based on the Shake Flask antimicrobial test outlined above was determined for each category of dried fabric in the bundle. The percent reduction was found to be 99.8 percent for both the T-shirt and toweling goods, while the percent reduction for the sweat shirt goods was 98.6 percent. The results indicate excellent antimicrobial activity at a relatively high concentration of the silane antimicrobial agent.

EXAMPLE II

In order to demonstrate the effectiveness of the antimicrobial agents of the present invention as rinse cycle additives at relatively low concentrations, Example I was repeated except on a laboratory scale. A Tergitometer was employed but a protocol similar to the protocol of Example I was followed in order to assimilate a fabric laundering rinse cycle treatment. An all cotton fabric goods sample was treated instead of a mixed goods bundle. In this example, much lower concentration levels of antimicrobial agent TMS were tested. The TMS antimicrobial agent was added as a single additive, and as an additive in admixture with non-quaternized and quaternized amines. The unquaternized amine was a simple amine with no ionization of the nitrogen. Each amine was also tested as a single additive, and a suitable control was employed. The Shake Flask antimicrobial test was employed in order to determine antimicrobial activity, and the percent reduction which was determined is reported in Table I for each of the various categories of combinations of rinse cycle additives employed in the assimilated laundering operation.

The Table clearly shows that a synergy was obtained between the TMS antimicrobial agent and the quaternized amine at low levels of concentration of additive. Thus, excellent antimicrobial activity was achieved as evidenced by a percent reduction of 95.6 employing an admixture of both ingredients. At the indicated ratio, this is equivalent to about 0.008 weight percent TMS and 0.001 weight percent BTC 2125, or levels at which neither additive was effective as a single ingredient. The non-quaternized amine is available from Armack Chemical Company, and the quaternized amine is available from Lonza, Inc., Fairlawn, N.J.

TABLE I

| Additive | Ratio | Treatment Level Weight Percent Total Actives | Percent Reduction[3] |
|---|---|---|---|
| ARQUAD[1] | — | .001 | 0 |
| | | .01 | 30.4[A] |
| TMS:ARQUAD[1] | 5:1 | .001 | 2.4 |
| | 5:1 | .01 | 2.6[A] |
| BTC[2] 2125 | — | .001 | 0 |
| | | .01 | 99.9[A] |
| TMS:BTC[2] 2125 | 5:1 | .001 | 0 |
| | 5:1 | .01[B] | 95.6[A] |
| TMS | — | .001 | 8.4 |
| | | .01 | 0 |
| Control | — | — | — |

[1]A non-quaternized amine $C_{18}H_{37}NH_3$ and a trademark of Armour Hess Chemical Company.
[2]A quaternized amine $C_{18}H_{37}N^+H_3Cl^-$ and a trademark of Onyx Chemical Company, Jersey City, New Jersey.
[3]Shake Flask test.
[A]Average of three determinations.
[B]At the prescribed ratio, this is equivalent to about 0.008 weight percent TMS and 0.001 weight percent BTC 2125; levels at which neither alone was effective.

Regarding the activity of the compounds of the present invention, such compounds have been found to be effective against a number of microorganisms, such as "BACTERIA": Gram (−); *Escherichia coli, Klebsiella pneumoniae, Klebsiella oxytoca, Pseudomonas aeruginosa, Pseudomonas fluorescens, Proteus mirabilis, Proteus vulgaris, Salmonella typhi, Salmonella typhimurium, Salmonella cholera suis, Enterobacter cloacae, Enterobacter aerogenes, Morganella morganii, Aeromonas hydrophila, Citrobacter freundii, Citrobacter deversus, Serratia marcescens, Serratia liquifaciens, Xanthomonas campestris, Acinetobacter calcoaceticus*; Gram (+): *Staphylococcus aureus, Staphylococcus epidermidis, Streptococcus mutans, Streptococcus pyogenes, Streptococcus fecalis, Micrococcus lutea, Bacillus sp.* (vegetative cell); "Fungi": *Aspergillus niger, Aspergillus flavus, Aspergillus sydowi, Aspergillus versicolor, Aspergillus terreus, Penicillium chrysogenum, Penicillium variabile, Penicillium funiculosum, Penicillium pinophilum, Poria placenta, Aureobasidium pullulans, Gloeophyllum trabeum, Chaetomium globosum, Trichoderma viride, Trichophyton mentagrophytes*; "Fungi" (yeasts): *Candida albicans, Candida pseudotropicalis, Saccharomyces cerevisiae.*

The treatment disclosed herein can be carried out with the quaternary ammonium compounds of this invention per se. Often, however, it is desirable to extend the compounds of this invention by incorporating therein hydrocarbon or halohydrocarbon substituted siloxanes of the formula $$R_aSiO_{\frac{4-a}{2}}$$

in which R is a hydrocarbon or halohydrocarbon radical and a varies from 0 to 3. The incorporation of such siloxanes in no way effects the property of the quaternary ammonium compound so that the claims of this invention are construed to cover both the use of quaternary ammonium siloxane per se and mixtures or copolymers of such siloxanes with said hydrocarbon substituted siloxanes or halohydrocarbon substituted siloxanes.

For example, surfaces can be treated with an aqueous solution of a mixture of 10 mols of monomethyl trimethysilane and 1 mol of $$Cl^-C_{18}H_{37}Me_2N^+(CH_2)_3Si(OMe)_3.$$

It has also been found that combinations of 1 mol $$Cl^{-}C_{18}H_{37}Me_2N^{+}(CH_2)_3Si(OMe)_3$$

and 0.5 mol of 3-chloropropyltrimethoxysilane give effective siloxane coatings. The use of hydrocarbon and halohydrocarbon siloxane extenders often give cheaper, more durable, more oleophilic or oleophobic surface treatments, than the pure quaternary siloxane.

It will be apparent from the foregoing that many other variations and modifications may be made in the compounds, compositions, and methods described herein without departing substantially from the essential features and concepts of the present invention. Accordingly, it should be clearly understood that the forms of the invention described herein are exemplary only and are not intended as limitations on the scope of the present invention.

That which is claimed is:

1. A rinse cycle fabric laundering additive composition comprising a mixture of at least one nonsilicon organic quaternary ammonium compound, and at least one organosilicon quaternary ammonium compound, the organosilicon quaternary ammonium compound being an organosilane having the formula selected from the group consisting of $$Y_{3-a}\underset{\underset{R_a'}{|}}{Si}R''N^{\oplus}R'''R''''R^{v}X^{\ominus}$$

and

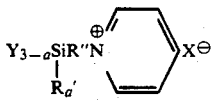

wherein, in each formula,

Y is R or RO where each R is an alkyl radical of 1 to 4 carbon atoms or hydrogen;

a has a value of 0, 1 or 2; R′ is a methyl or ethyl radical;

R″ is an alkylene group of 1 to 4 carbon atoms;

R‴, R⁗ and $R^{v}$ are each independently selected from a group consisting of alkyl radicals of 1 to 18 carbon atoms, $—CH_2C_6H_5$, $—CH_2CH_2OH$, $—CH_2OH$, and $—(CH_2)_xNHC(O)R^{vi}$, wherein x has a value of from 2 to 10 and $R^{vi}$ is a perfluoroalkyl radical having from 1 to 12 carbon atoms; and X is chloride, bromide, fluoride, iodide, acetate or tosylate.

2. The composition of claim 1 in which the organosilane and the organic quaternary ammonium compound are each present in the mixture in a ratio of about 5:1.

3. A method of treating fabrics in a fabric laundering operation which includes a wash cycle followed by a rinse cycle in order to eliminate odor caused by microbial growth comprising the step of adding an antibacterially effective amount of an organosilicon quaternary ammonium compound to the rinse cycle of the laundering operation containing the fabrics in order to destroy bacteria and fungi causing the odor, the organosilicon quaternary ammonium compound being an organosilane having the formula selected from the group consisting of $$Y_{3-a}\underset{\underset{R_a'}{|}}{Si}R''N^{\oplus}R'''R''''R^{v}X^{\ominus}$$

and

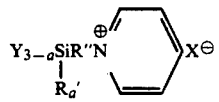

wherein, in each formula,

Y is R or RO where each R is an alkyl radical of 1 to 4 carbon atoms or hydrogen;

a has a value of 0, 1 or 2;

R′ is a methyl or ethyl radical;

R″ is an alkylene group of 1 to 4 carbon atoms;

R‴, R⁗ and $R^{v}$ are each independently selected from a group consisting of alkyl radicals of 1 to 18 carbon atoms, $—CH_2CH_6H_5$, $—CH_2CH_2OH$, $—CH_2OH$, and $—(CH_2)_xNHC(O)R^{vi}$ wherein x has a value of from 2 to 10 and $R^{vi}$ is a perfluoroalkyl radical having from 1 to 12 carbon atoms; and X is chloride, bromide, fluoride, iodide, acetate or tosylate.

4. The method of claim 3 in which the organosilane is added to the rinse cycle in the form of an emulsion containing the organosilane active ingredient.

5. The method of claim 3 in which the organosilane is added to the rinse cycle in the form of a microemulsion containing the organosilane active ingredient.

6. The method of claim 3 in which the organosilane is added to the rinse cycle in admixture with a nonsilicon organic quaternary ammonium compound, the organosilane and the organic quaternary ammonium compound being added to the rinse cycle in an amount of about 0.01 percent by weight of the admixture based on the weight of the fabrics.

7. The method of claim 6 in which the organosilane and the organic quaternary ammonium compound are each present in the admixture in a ratio of about 5:1.

* * * * *